US006932644B1

(12) United States Patent
Taylor

(10) Patent No.: US 6,932,644 B1
(45) Date of Patent: Aug. 23, 2005

(54) DISSIMILAR METAL HERMETIC CONNECTOR

(75) Inventor: Edward Allen Taylor, E. Wenatchee, WA (US)

(73) Assignees: SRI Hermetics Inc., Melbourne, FL (US); Edward Taylor, W. Melbourne, FL (US)

( * ) Notice: Subject to any disclaimer, the term of this patent is extended or adjusted under 35 U.S.C. 154(b) by 0 days.

(21) Appl. No.: 10/814,984

(22) Filed: Mar. 31, 2004

(51) Int. Cl.[7] ..... H01R 13/73
(52) U.S. Cl. ..... 439/566
(58) Field of Search ..... 439/566, 608, 439/935; 174/152 GM

(56) References Cited

U.S. PATENT DOCUMENTS

| | | | | |
|---|---|---|---|---|
| 4,221,447 A | * | 9/1980 | Powell | 439/252 |
| 4,690,480 A | | 9/1987 | Snow et al. | 439/364 |
| 4,952,173 A | * | 8/1990 | Peronnet et al. | 439/583 |
| 4,960,391 A | * | 10/1990 | Beinhaur et al. | 439/559 |
| 5,025,347 A | * | 6/1991 | Shindo et al. | 361/719 |
| 5,041,019 A | | 8/1991 | Sharp et al. | 439/559 |
| 5,109,594 A | | 5/1992 | Sharp et al. | 29/600 |
| 5,110,307 A | | 5/1992 | Rapoza | 439/566 |
| 5,213,520 A | * | 5/1993 | Casey et al. | 439/559 |
| 5,298,683 A | | 3/1994 | Taylor | 174/152 |
| 6,821,145 B1 | * | 11/2004 | DeSantis et al. | 439/559 |

* cited by examiner

*Primary Examiner*—Thanh-Tam Le
(74) *Attorney, Agent, or Firm*—Allen, Dyer, Doppelt, Milbrath & Gilchrist, P.A.

(57) ABSTRACT

A hermetically sealed connector comprises an outer metallic shell having an aperture that receives a multipin-retaining, multi-metallic insert. The insert is a laminate of dissimilar metals, including a first metal extending to a first side of the insert and having a first coefficient of thermal expansion (CTE), and a second metal extending to a second side of the insert and having a second CTE different that the first CTE. A plurality of bores extend between first and second sides of the insert and contain connector pins that are hermetically sealed with the first metal of the insert by a dielectric material formed between the pins and sidewalls of the bores. A bond joint is formed between the second metal of the insert and the side of the outer metallic shell adjacent to the second side of the metallic insert.

31 Claims, 1 Drawing Sheet

DISSIMILAR METAL HERMETIC CONNECTOR

FIELD OF THE INVENTION

The present invention relates in general to hermetic connector arrangements employing dissimilar metals, and is particularly directed to a new and improved connector architecture, which employs a dissimilar metal interface between a single pin or a multi-pin hermetic sealing region and a surrounding connector shell.

BACKGROUND OF THE INVENTION

The use of metallurgically bonded, dissimilar sheet metal has been known to the art of hermetic connector manufacturing for a number of years. One method used to manufacture this bonded sheet metal is through the use of explosives in a process called explosive welding. An explosive weld connotes the metallurgical bond created at the point of impact when one metal sheet is driven into another by the force of an explosion. An explosive weld is distinguished, for example, from a friction weld, i.e. the metallurgical bond created between two metals when they are rubbed together under high pressure conditions. A dissimilar metals sheet is a sheet of metal consisting of two or more layers of distinctly different metals which have been joined together by, for example, explosive welding. Other ways to produce dissimilar metal sheet material exist, for example friction welding, roll bonding and supersonic forming.

Similar metals may be interfaced with each other by standard procedures such as brazing, soldering, laser welding or the like. Dissimilar metals, e.g., metals characterized by differing thermal expansion properties, melting points, weld incompatibility or the like, do not reliably interface using such standard procedures. For example, iron cannot be reliably laser welded to aluminum and solder joints between iron and aluminum have a definite thermal fatigue cycle life due to the significant difference in their thermal expansion properties. As a result, iron-based metal connectors cannot be reliably soldered or laser welded to aluminum electronics packages for sustained periods of operation.

The introduction of the transition bushing, i.e., a ring cut from a sheet of dissimilar metal that consists of at least two different metals with the purpose of providing one metal to interface with a connector and the other to interface with an electronics package, has provided a solution to the problems associated with the standard connector mounting process, such as the inability to weld dissimilar metals or the unreliable process of soldering incompatible metals together. For example, the transition bushings described in the U.S. patent to Sharp et al, U.S. Pat. No. 5,109,594 and the U.S. patent to Rapoza, U.S. Pat. No. 5,110,307 allow low expansion iron-based connectors to be interfaced to a high expansion electronic package, such as aluminum.

Transition bushings have a number of drawbacks, some of which are detailed in the U.S. patent to Taylor, U.S. Pat. No. 5,298,683; these include the increased size and weight of the connector assembly when a transition bushing is added, as well as the addition of another component to the assembly parts list. The transition bushing can be incorporated into the connector shell if a custom connector is designed with this approach in mind, as detailed in the above-referenced patent to Taylor and the U.S. patent to Snow, U.S. Pat. No. 4,690,480. The integration of the dissimilar metal sheet material into the connector body is one way to decrease the size and weight of the connector assembly. It also addresses the drawback of an extra component because the transition bushing, rather than being a separate part, is now part of the connector.

All prior art connectors designed per the Snow, Sharp, Rapoza or Taylor patents are manufactured from two main components. The first component is the exterior portion of the connector, which is always manufactured from dissimilar metals sheet material. This part of the connector can be in the form of a transition bushing or a dissimilar metal sheet can be used to provide a connector shell, also known as the connector body.

The second main component is the part of the connector that contains the hermetically sealed, electrically insulated feed through pin. This part can take the form of a standard one piece connector when used in conjunction with a transition bushing as described in the Rapoza patent or a multi-pin header as described in the Sharp patent. It can also take the form of a simple single pin feed through as described in the Snow and Taylor patents, as well as a multi-pin insert assembly as further described in the Taylor patent.

A common feature of all the prior art connectors is the fact that the dissimilar metal component is never part of the dielectric sealing process. The dielectric material, usually glass or ceramic, surrounds the feed through pin and is sealed into the second main component through a high temperature process of brazing or glass/ceramic fusion, i.e., melting the glass or ceramic dielectric material, allowing it to flow into the cavity of the second component around the feed through pin.

This type of connector architecture is diagrammatically illustrated in the side sectional view of FIG. 1. As shown therein, a first main component of the connector comprises an outer connector shell or body 10, which is typically made of dissimilar metal sheet material composed of aluminum and stainless steel, and a second main component comprising an interior insert 20 made of stainless steel. The connector shell 10 is configured so as to surround and abut against the outer extremity of the stainless steel insert 20. The latter is provided with a plurality of parallel holes or apertures 22 that are sized to receive associated connector pins 24. These connector pins are held in place and hermetically sealed within the apertures 22 by means of a glass or ceramic material 26, which fill those portions of the apertures surrounding the individual pins 24. Also shown in Figure is a perforated interfacial gasket 28, through apertures in which upper portions 25 of the pins 24 protrude, as shown. Lower portions 27 of the pins extend outwardly from the bottom of the stainless steel insert, as shown.

In this-type of connector architecture, the stainless steel insert 20 is secured to the surrounding shell 10 by means of a laser weld joint 30 formed between the bottom peripheral edge 21 of the insert 20 and the bottom peripheral edge 31 of an adjacent stainless steel piece 32, shown in cross-section as having a generally inverted 'L' shape. This inverted L shaped stainless steel piece 32 is a typical example of the small amount of stainless steel which is left as part of the connector shell after machining the shell from the explosion welded dissimilar metal material. It is typically bonded to a bottom region 12 of the surrounding shell 10 by explosion bonding, so as to form a generally annular ribbon-configured explosion bond region around the underside of the shell 10 to which the insert 20 may be laser welded. The shell is further shown as having a pair of threaded jack posts 14 and 15, and may be welded or soldered to an adjacent housing 40. A drawback to the structure shown in FIG. 1 is the relative narrowness of the annular shaped explosion bond formed between the inverted L-shaped stainless steel piece 32 and the underside of the connector shell 10, which facilitates the propagation of defects in the explosion bond region.

SUMMARY OF THE INVENTION

In accordance with the present invention, these and other shortcomings of conventional dissimilar metal employing connector architectures of the type described above are effectively obviated by forming the multipin-retaining insert of dissimilar metals, one of which (e.g., stainless steel) provides strength and rigidity and provides for hermetic (e.g., glass) sealing of the multipin structure, and the other of which facilitates bonding (e.g., soldering, welding) with a like coefficient of thermal expansion or metallurgically compatible material of the surrounding connector shell, sleeve or body.

A first main component of the inventive connector comprises an outer connector shell, sleeve or body, which is typically made of a material such as aluminum, an aluminum alloy, or a metal that has a coefficient of thermal expansion compatible therewith, so as to facilitate its connection and integration into a like or similar metallic housing or chassis. Other suitable materials include titanium, stainless steel, carbon steel, kovar and Fe/Ni alloys. A second main component comprises an interior insert that is made of a laminated structure containing at least two dissimilar metals. As a non-limiting example, this interior insert may comprise a first sheet or layer of aluminum, whose coefficient of thermal expansion properties of which are compatible with those of the surrounding (aluminum) connector shell. Other materials include stainless steel, carbon steel, kovar and Fe/Ni alloys. This first metal sheet is bonded to an overlying layer of a dissimilar metal (such as stainless steel), which serves to provide strength and rigidity and facilitates hermetic sealing of the multipin structure. In accordance with a non-limiting, but preferred embodiment, the first and second metallic sheets may be laminated to one another by explosion bonding. Also the second metallic sheet may comprise the same material as the shell material.

The connector shell is configured so as to surround and abut against the outer extremity of the laminated dissimilar metal containing insert. Also, the multi-metallic insert is provided with a plurality of parallel bores that are sized to receive associated connector pins which are held in place and hermetically sealed within the bores of the stainless steel layer of the insert by a glass or ceramic material, which fill those portions of the bores surrounding the individual pins. A perforated interfacial neoprene rubber gasket lies atop the stainless steel layer so that upper portions of the pins protrude through the perforations in the gasket. Lower portions of the pins extend outwardly from the bottom of the insert.

The glass or ceramic material which serves as the hermetically sealing dielectric material for each of the pins need only extend within the thickness of the stainless steel layer portion of the insert. Pursuant to the invention, the hermetically sealing dielectric material has a melting point below that of aluminum, so that processing of the dielectric material to realize the hermetic sealing does not degrade the integrity of the bond between the stainless steel layer and the aluminum layer of which the dissimilar metal insert is made. As a non-limiting example, the dielectric material may comprise low temperature glass materials, such as Ceramax (Reg. Tdmk.), or metalized aluminum oxide, which has been brazed into place using low temperature braze alloys, such as gold/tin or gold/germanium.

In accordance with the invention, the stainless steel/aluminum laminate insert is readily securely bonded to the surrounding connector shell by means of a laser weld joint formed between the bottom peripheral edge of the aluminum layer and the bottom peripheral edge of the aluminum connector shell.

Pursuant to a second embodiment, the connector shell is integrated within a surrounding housing. The duality of materials (stainless steel and aluminum) of the metal insert remains the same as in the first embodiment, so that joint between the aluminum layer of the insert and the aluminum material of the surrounding shell is accomplished in the same manner in both embodiments.

DETAILED DESCRIPTION

Figure 1:
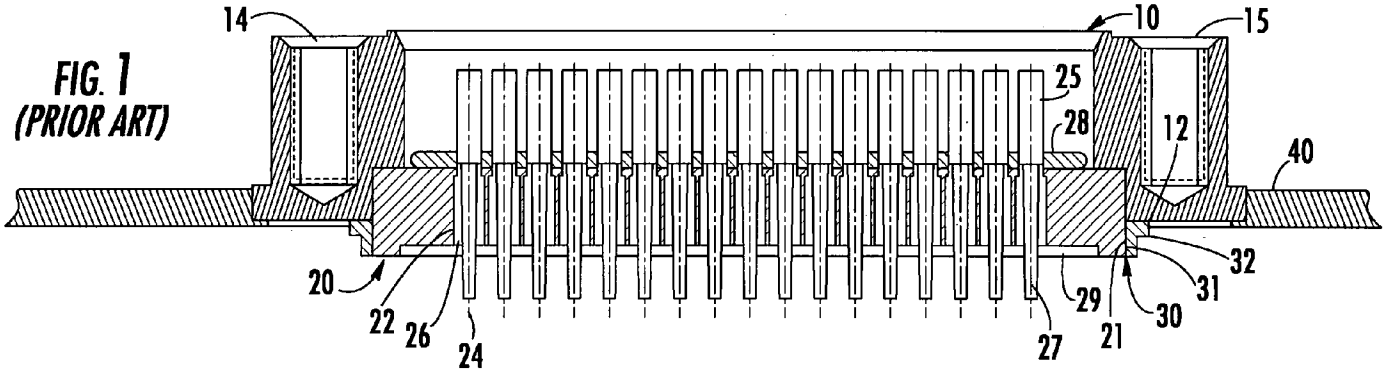
FIG. 1 (PRIOR ART)
FIG. 1 diagrammatically illustrates a conventional hermetically sealed multipin connector architecture.

As pointed out briefly above, drawbacks of conventional dissimilar metal employing connector architectures of the type shown in FIG. 1 are effectively obviated in accordance with the present invention by forming the multipin-retaining insert of dissimilar metals, one of which (e.g., stainless steel) provides strength and rigidity and facilitates hermetic sealing of the multipin structure, and the other of which (e.g., aluminum) facilitates bonding with the material of the surrounding connector shell.

Figure 2:
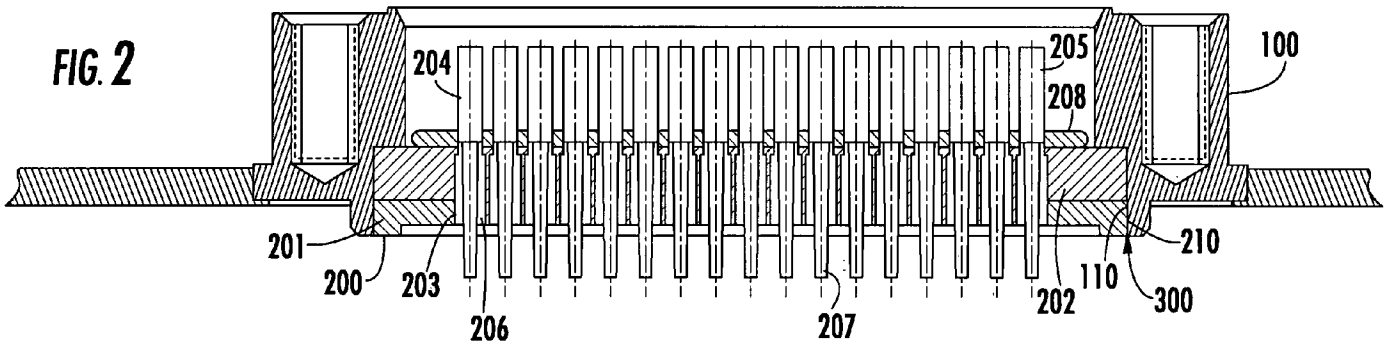
FIG. 2 is a diagrammatic side sectional view of a hermetically sealed multipin connector architecture in accordance with a first embodiment of the invention.

This inventive connector architecture is diagrammatically illustrated in the side sectional view of FIG. 2. As shown therein, a first main component of the connector comprises an outer connector shell or body 100, which is typically made of aluminum, and aluminum alloy or a metal that has a coefficient of thermal expansion compatible therewith, so as to facilitate its connection and integration into a like or similar metallic housing or chassis, and a second main component comprising an interior insert 200 made of a laminated structure containing at least two dissimilar metals. (Metallurgical compatibility is important for laser welding and CTE compatibility is important for soldering.)

As a non-limiting example, insert 200 may comprise a first sheet or layer 201 of aluminum, aluminum alloy or a metal that has a coefficient of thermal expansion compatible therewith, so that its coefficient of thermal expansion properties are compatible with those of the surrounding (aluminum) connector shell. This first metal sheet is bonded to an overlying layer 202 of dissimilar metal (for example, a ferrous based metal such as stainless steel) which provides strength and rigidity and facilitates hermetic sealing of the multipin structure. In accordance with a non-limiting, but preferred embodiment, the first and second metallic sheets may be bonded to one another by explosion bonding.

As in the architecture of FIG. 1, the connector shell 100 is configured so as to surround and abut against the outer extremity of the metal insert 200. Also, the insert 200 is provided with a plurality of parallel holes or apertures 203, that are sized to receive associated connector pins 204. The pins 204 are held in place and hermetically sealed within the apertures 203 by means of a suitable glass or ceramic material 206, that fill those portions of the apertures surrounding the individual pins 204. As a non-limiting example, the glass or ceramic material may comprise low temperature glass materials, such as Ceramax (Reg. Tdmk.), or metallized aluminum oxide, which has been brazed into place using low temperature braze alloys, such as gold/tin or gold/germanium.

In accordance with one aspect of the present invention, because these materials have melting points below that of aluminum, they do not degrade the integrity of the bond between the stainless steel layer and the aluminum layer of which the dissimilar metal insert is made. A perforated interfacial gasket 208, such as a neoprene rubber gasket, lies atop the stainless steel sheet 202 with the upper portions 205 of the pins 204 protruding through the perforations in the gasket, as shown. Lower portions 207 of the pins extend outwardly from the bottom of the insert 200, as shown.

Although shown as extending to the bottom of the insert 200, the glass or ceramic material 206 which serves as the hermetically sealing dielectric material for each of the pins, need not extend beneath the interface between the topside stainless steel layer 202 and the underneath layer of aluminum 201. It need only extend within the thickness of the stainless steel layer 202.

In accordance with the connector architecture of FIG. 2, the stainless steel/aluminum laminate insert 200 is readily secured to the surrounding shell 100 by means of a solder or laser weld joint 300 formed between the bottom peripheral edge 210 of the aluminum layer 201 and the bottom peripheral edge 110 of the aluminum connector shell 100.

Figure 3:
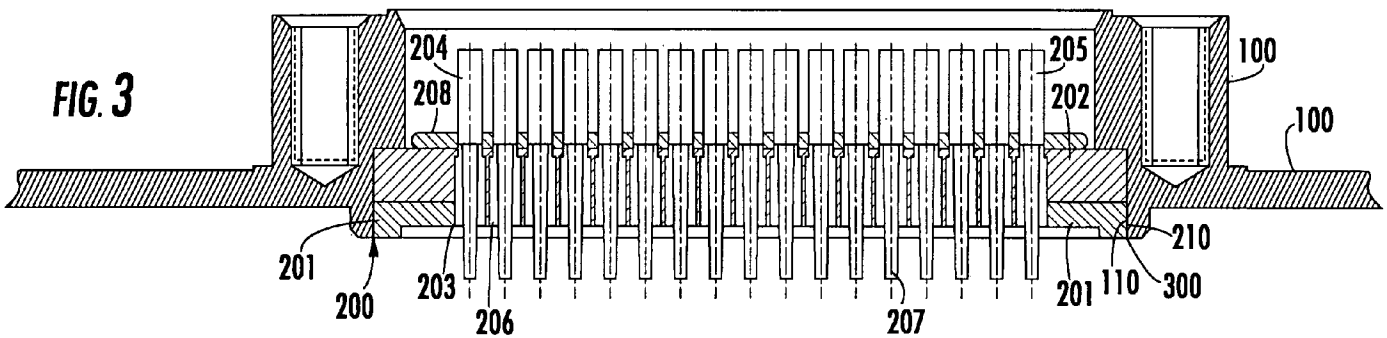
FIG. 3 is a diagrammatic side sectional view of a hermetically sealed multipin connector architecture in accordance with a second embodiment of the invention.

FIG. 3 shows a modification of the embodiment of FIG. 2, wherein the connector shell is integrated within a surrounding housing. The duality of materials (stainless steel and aluminum) of the metal insert remains the same as in the embodiment of FIG. 2, so that joint between the aluminum layer 201 of the insert 200 and the aluminum material of the surrounding shell 100 is accomplished in the same manner in both embodiments.

As will be appreciated from the foregoing description, the present invention provides a hermetic electrical connector architecture, which may be fabricated with external shell materials of any desirable metal without compromising the hermetic reliability of the connector itself. Installed within the connector shell is an insert which is fabricated from a metal laminate sheet containing at least two dissimilar metals which provide a means for the connector shell to interface with the insert while also providing the optimum material for the incorporation of the dielectric seal material, usually glass.

In this manner, the inner portion of the connector, namely, the insert, which contains the hermetic dielectric sealing (glass) material, is provided the appropriate metal (stainless steel) to seal as one of the constituents of a metallurgically bonded dissimilar metal laminate material. Additionally, at least one of the other constituents (aluminum) of the dissimilar metal insert is provided to interface with the outer portion of the connector.

Further, as shown in FIG. 3, referenced above, this design is also applicable to the incorporation of the connector shell directly into the electronic package wall when the electronic package and the connector are designed to be the same material; this is an advantage which is not possible with the prior art. In this case the connector shell and the electronic package are actually manufactured as a single component and the insert is joined directly to the shell/package component.

While I have shown and described several embodiments in accordance with the present invention, it is to be understood that the same is not limited thereto but is susceptible to numerous changes and modifications as known to a person skilled in the art. I therefore do not wish to be limited to the details shown and described herein, but intend to cover all such changes and modifications as are obvious to one of ordinary skill in the art.

What is claimed:

1. An article of manufacture comprising:

an outer metallic shell having an aperture therethrough sized to receive a conductor pin-retaining metallic insert;

said conductor pin-retaining metallic insert comprising a laminate of dissimilar metals, including a first metal having a first coefficient of thermal expansion, and a second metal having a second coefficient of thermal expansion that is different from said first coefficient of thermal expansion;

at least one aperture extending through said metallic insert and containing at least one conductor pin hermetically sealed therewith by a dielectric material formed between said at least one conductor pin and a sidewall of said at least one aperture; and a hermetic bond joint formed between said second metal of said metallic insert and metallic material of said outer metallic shell.

2. The article of manufacture according to claim 1, wherein said hermetic bond joint comprises a solder joint.

3. The article of manufacture according to claim 1, wherein said hermetic bond joint comprises a weld joint.

4. The article of manufacture according to claim 1, wherein said second coefficient of thermal expansion is proximate to the coefficient of thermal expansion of said outer metallic shell.

5. The article of manufacture according to claim 1, wherein said second coefficient of thermal expansion is higher than said first coefficient of thermal expansion.

6. The article of manufacture according to claim 1, wherein said second coefficient of thermal expansion is lower than said first coefficient of thermal expansion.

7. The article of manufacture according to claim 1, wherein said outer metallic shell and said second metal of said conductor pin-retaining metallic insert comprise aluminum, and aluminum alloy or a metal that has a coefficient of thermal expansion compatible therewith.

8. The article of manufacture according to claim 7, wherein said first metal of said conductor pin-retaining metallic insert comprises stainless steel.

9. The article of manufacture according to claim 1, wherein said outer metallic shell and said second metal of said conductor pin-retaining metallic insert comprise materials selected from titanium, stainless steel, kovar and iron/nickel alloys.

10. The article of manufacture according to claim 7, wherein said first metal is kovar, iron/nickel alloy or carbon steel.

11. The article of manufacture according to claim 1, wherein said dielectric material has a process temperature below the melting point of said second metal.

12. The article of manufacture according to claim 11, wherein said dielectric material comprises at least one of a glass and a ceramic material.

13. The article of manufacture according to claim 1, wherein said at least one aperture comprises a plurality of apertures extending through said metallic insert and containing respective ones of a plurality of conductor pins hermetically sealed therewith by dielectric material formed between said conductor pins and sidewalls of said plurality of apertures.

14. The article of manufacture according to claim 1, wherein said outer metallic shell and a package wall therefor are formed as an integrated structure.

15. A multipin connector for hermetically sealing a plurality of connector pins therein, comprising:

an outer metallic shell having an aperture therethrough sized to receive a multipin-retaining metallic insert;

said multipin pin-retaining metallic insert comprising a laminate of dissimilar metals, including a first metal extending to a first side of said insert and having compatibility with hermetic sealing of an electrically insulated metal pin, and a second metal extending to a second side of said insert and having metallurgical compatibility with said outer metallic shell to facilitate a hermetic bond therewith;

a plurality of apertures extending between said first and second sides of said metallic insert and containing a plurality of connector pins that are hermetically sealed with said first metal of said insert by a dielectric material formed between said pins and sidewalls of said apertures; and a bond joint formed between said second metal of said metallic insert and metallic material at a side of said outer metallic shell adjacent said second side of said metallic insert.

16. The multipin connector according to claim 15, wherein said outer metallic shell and said second metal of said conductor pin-retaining metallic insert comprise aluminum, and aluminum alloy or a metal that has a coefficient of thermal expansion compatible therewith.

17. The multipin connector according to claim 15, wherein said outer metallic shell and said second metal of said conductor pin-retaining metallic insert comprise titanium and ferrous alloys, such as Kovar, stainless steel and ferrous/nickel alloys.

18. The multipin connector according to claim 15, wherein said first metal of said conductor pin-retaining metallic insert comprises stainless steel.

19. Multipin connector according to claim 13, wherein said first metal is kovar, iron/nickel alloy or carbon steel.

20. The multipin connector according to claim 15, wherein said dielectric material has a process temperature below the melting point of said second metal.

21. The multipin connector according to claim 20, wherein said dielectric material comprises at least one of glass and ceramic material.

22. The multipin connector according to claim 13, wherein said outer metallic shell and a package wall therefor are formed as an integrated structure.

23. A method of forming a multipin connector for hermetically sealing a plurality of connector pins therein, comprising the steps of:

(a) providing an outer metallic shell having an aperture therethrough that is sized to receive a multipin-retaining metallic insert;

(b) providing a metallic insert that is sized to be captured in said aperture of said outer metallic shell, said metallic insert comprising a laminate of dissimilar metals, including a first metal extending to a first side of said insert and having a first coefficient of thermal expansion, and a second metal extending to a second side of said insert and having a second coefficient of thermal expansion different from said first coefficient of thermal expansion and proximate to the coefficient of thermal expansion of said outer metallic shell;

(c) forming a plurality of apertures in said metallic insert so that said plurality of apertures extend between said first and second sides of said metallic insert;

(d) hermetically sealing a plurality of connector pins within said plurality of apertures in said metallic insert by means of a dielectric material formed between said connector pins and sidewalls of said apertures of said first metal of said metallic insert; and (e) inserting said metallic insert into said aperture of said outer metallic shell, and forming a bond joint between said second metal of said metallic insert and metallic material at a side of said outer metallic shell adjacent said second side of said metallic insert.

24. The method according to claim 23, wherein said dielectric material has a process temperature below the melting point of said second metal.

25. The method according to claim 24, wherein said dielectric material comprises at least one of glass and ceramic material.

26. The method according to claim 23, wherein said outer metallic shell and said second metal of said conductor pin-retaining metallic insert comprise aluminum, and aluminum alloy or a metal that has a coefficient of thermal expansion compatible therewith.

27. The method according to claim 23, wherein said outer metallic shell and said second metal of said conductor pin-retaining metallic insert comprise materials selected from titanium, stainless steel, kovar and iron/nickel alloys.

28. The method according to claim 26, wherein said first metal of said conductor pin-retaining metallic insert comprises stainless steel.

29. The method according to claim 26, wherein said first metal of said conductor pin-retaining metallic insert comprises a material selected from kovar, Fe/Ni alloys and carbon steel.

30. The method according to claim 23, wherein said second metal of said conductor pin-retaining insert is welded to said outer metallic shield.

31. The method according to claim 23, wherein said second metal of said conductor pin-retaining insert is soldered to said outer metallic shell.

* * * * *